United States Patent [19]

Illich

[11] Patent Number: 4,718,212

[45] Date of Patent: Jan. 12, 1988

[54] CONCRETE INSERT

[76] Inventor: Daniel Illich, 149-44 Cherry Ave., Flushing, N.Y. 11355

[21] Appl. No.: 942,996

[22] Filed: Dec. 18, 1986

[51] Int. Cl.[4] ..... E04B 1/41

[52] U.S. Cl. ..... 52/699

[58] Field of Search ..... 52/698, 699

[56] References Cited

FOREIGN PATENT DOCUMENTS 2604850 8/1977 Fed. Rep. of Germany ..... 52/698

1213108 of 1959 France ..... 52/699

*Primary Examiner*—J. Karl Bell

*Attorney, Agent, or Firm*—Arthur T. Fattibene

[57] ABSTRACT

A continuous concrete insert in the form of a channel shaped structural member having opposed side portions and a connected web portion. The web portion is formed with a plurality of pair of spaced apart slots arranged to frictionally retain an anchoring member in the form of a U-shaped staple or member. The intermediate portion of the staple is disposed contiguous to one side of the connected web portion and the opposed leg portions of the staple being projected through the pair of slots so as to extend to the other side of the web portion, and a fastener is provided for securing the structural member in place to a concrete form.

10 Claims, 6 Drawing Figures

FIG 1
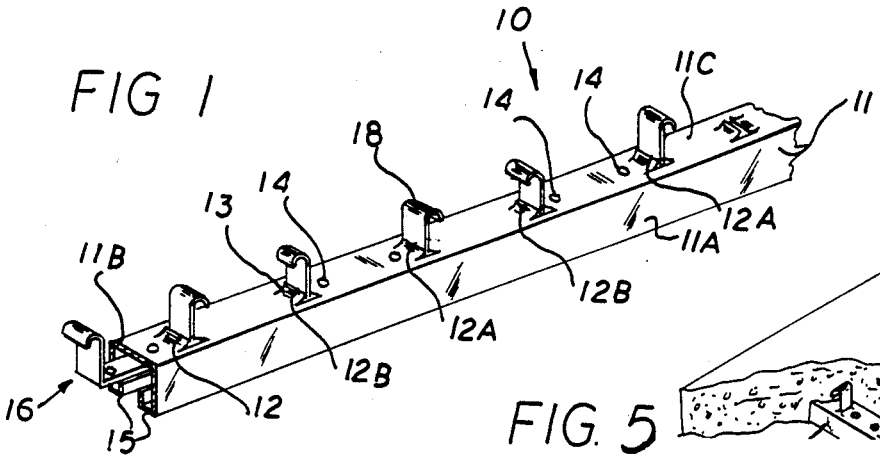
FIG. 5
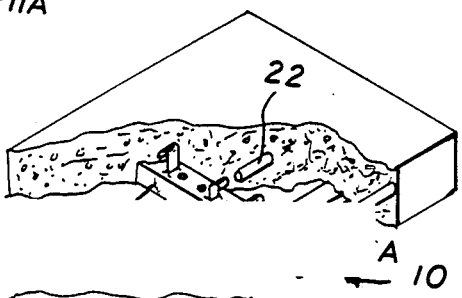
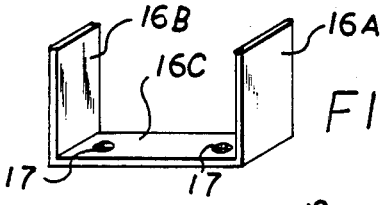
FIG. 2
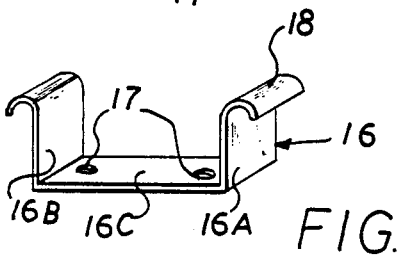
FIG. 3
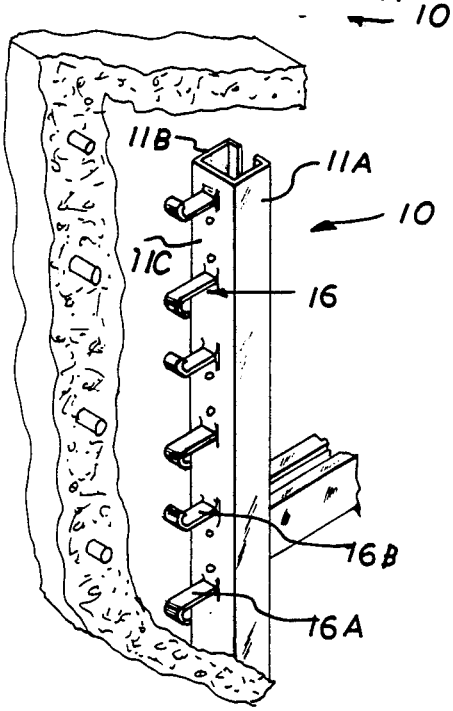
FIG. 6
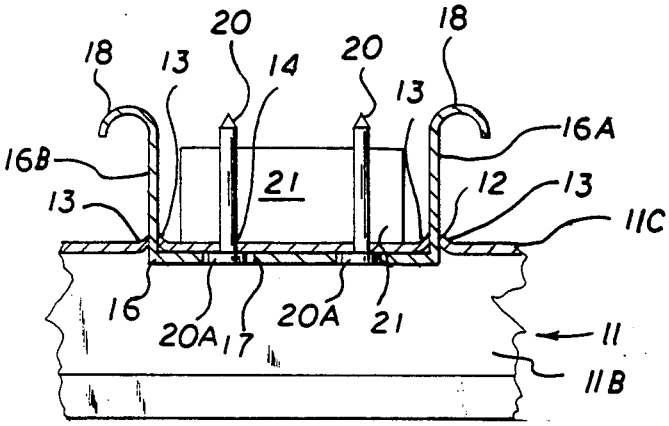
FIG. 4

CONCRETE INSERT

FIELD OF INVENTION

This invention is directed to improvements in a concrete insert for use in the construction industry to provide a support or channel in a poured concrete surface.

PROBLEM AND PRIOR ART

Concrete inserts are commonly used in concrete structures or buildings to provide a means for supporting pipes, conduits and other structures or building components. The known concrete inserts comprise an elongated channel shaped member which are formed with tabs which are blanked out of the surface of the web portion of the channel member. Such tabs so blanked out of the web portion are bent out of the plane of the web to a position generally normal thereto. The blanking of such tabs out of the plane of the web portion of the channel results in relatively large openings spaced longitudinally of the channel. Such resulting openings are undesirable because they weaken the structural member and allow concrete to seep into the channel member. To avoid the seepage of concrete into the channel, efforts have been made to provide covers for the openings resulting from the blanked out tabs. While such covers may obviate the seepage of the concrete into the channels, such covers did not compensate for any lost strength resulting from the blanking of the tabs from the web of the channel.

OBJECTS

An object of this invention is to provide a concrete insert with anchoring tabs which are not blanked out of the material of the channel.

Another object is to provide a concrete insert construction which obviates the above noted deficiencies.

Another object is to provide a concrete insert that can be readily constructed and which is positive in operation.

SUMMARY OF THE INVENTION

The foregoing objects and other features and advantages are attained by an elongated or continuous channel shaped member whereby the web portion of the channel is provided with a plurality of slots at spaced intervals along the length of the channel member to define a plurality of paired slots. The respective slots are formed by blanking a portion of the channel member slightly out of plane of the web portion. Anchoring members in the form of a U-shaped staple are spaced along the length of the channel member. The arrangement is such that the opposed leg portions of the anchoring staple are projected through a pair of adjacent slots formed in the web portion of the channel member and frictionally retained therein so that the leg portions project to one side of the web portion, and the intermediate portion of the staple is disposed contiguous to the other side of the web portion. Aligned apertures are formed in the intermediate portion of the staple and the web of the channel through which a fastener is inserted for securing the concrete insert to a concrete form. The free ends of the staple are reversely bent.

FEATURES

A feature of this invention resides in the provision wherein the anchoring members are formed as separate and distinct members which are frictionally secured to the web portion of the channel at spaced intervals therealong.

Another feature resides in the provision whereby the spaced apart slots are formed by blanking and by displacing the blanked out portion slightly beyond the plane of the blank to define a frictional retaining slot.

Another feature resides in the provision whereby the anchoring members are frictionally secured to the web portion of the channel member.

Another feature resides in a concrete insert constructed in a manner which prohibits any seepage of wet concrete into the channel member.

Other features and advantages will become more readily apparent when considered in view of the drawings and description in which:

FIG. 1 is a perspective view of a concrete insert embodying the present invention.

FIG. 2 is a detail perspective view of the staple component part in its preformed state.

FIG. 3 is a perspective view of the staple component part formed curved ends as used in the assembled position.

FIG. 4 is a partial sectional view taken along line 4—4 on FIG. 1.

FIG. 5 illustrates the concrete insert of the present invention utilized as a horizontal member.

FIG. 6 illustrates the concrete insert of this invention utilized as a vertical member.

DETAIL DESCRIPTION

Referring to the drawing, therein is illustrated a continuous concrete insert embodying the present invention. As shown, the concrete insert 10 comprises a continuous or elongated channel shaped member 11 defined by a pair of opposed side portions **11*a*, 11*b*, interconnected by a web portion 11*c*. Formed in the surface of the web portion 11*c* are a plurality of spaced apart slots 12. As best seen in FIG. 1, the respective slots 12 are formed by blanking a tab portion 13 slightly out of the plane of the web portion 11*c* to define the slot 12. The arrangement is such that the adjacent slots define a pair of slots, e.g. 12*a*, 12*b*. Disposed between each pair of slots 12*a*, 12*b*, there is provided one or more apertures or opening 14. In the illustrated embodiment, two such openings or apertures are shown. Also, as seen in FIG. 1, the free ends of the respective side portions 11*a*, 11*b* of the channel member 11 are inwardly and reversely turned as indicated at 15**.

Spaced along the length of the channel member 11 are a plurality of similarly constructed anchoring means 16. As best seen in FIG. 2, the respective anchoring means comprises a distinct member which is generally U-shaped to define a staple like member having opposed leg portions **16*a*, 16*b* and a connecting intermediate portion 16*c*. Preferably, the anchoring member is formed of a flat stock structural material. As noted in FIGS. 2 & 3, the intermediate portion 16*c* of the staple 16 is formed with spaced openings 17 which, in the assembled position, are arranged to be disposed in alignment with the openings or apertures 14 formed in the web portion 11*c* of the channel member 11**.

To assemble the anchoring means 16 to the channel members, the opposed leg portions **16*a*, 16*b* of the staple 16 are inserted so as to project through a pair of adjacent slots, e.g. 12*a*, 12*b*, so that the leg portions project to one side of the web portion 11*c*. The intermediate portion 16*c* of the staple 16 is disposed contiguous to the interior or other surface of the web portion 11***c*. As best seen in FIG. 4, the slot 12 formed by the slightly displaced blanked tab 13 functions to frictionally retain the staple 16 in place. The arrangement is such that the opposed leg portions of the staple 16 can be readily forced through the slots 12*a*, 12*b*, and frictionally retained in place therein. When the staple 16 has been fully inserted, the tab 13 defining the opening 12 bears against the leg portion in a manner that will resist any unintentional displacement of the anchoring means or staple 16. With the anchoring means or staple secured to the channel member, the free ends of the leg portions 16*a*, 16*b* are reversely bent as noted at 18.

A fastener, e.g., a stud or nail or the like 20, is projected through the aligned apertures 14 and 17 to secure the channel to a concrete form 21. In the illustrated embodiment, the fastener 20 is provided with an enlarged head portion 20*a* which has a diameter larger than that of aperture 14.

As best seen in FIG. 5, the concrete insert as described can be readily used in either a horizontally poured slab, or in a vertically poured slab as in FIG. 6. Thus, the insert 10 defines a support for various hangers and other structural members required in the construction of a building. The arrangement is such that the reversely bent ends 18 of the anchor means can function to support the insert 10 from the reinforcing rods 22, if desired, and which anchor means 16 are imbedded in the wet concrete when poured. Upon curing, the inserts are permanently in place in the concrete slab.

While the invention has been described with respect to a particular embodiment thereof, it will be readily apparent that variations and modifications may be made without departing from the spirit or scope of the invention.

What is claimed is:

1. A concrete insert comprising a smooth uninterrupted elongated channel shaped structural member having opposed continuous side portions and an interconnected web portion, said web portion having a plurality of transversely extending slots spaced therealong, said slots being paired, the distance between each slot in said pair of slots being greater than the transverse width of said web portion, and a plurality of anchoring means spaced along said web portion, said anchoring means including a U-shaped staple having opposed leg portions, said leg portions being extended through a corresponding slot of said pair of slots, said opposed leg portions being frictionally retained in its corresponding slot, and means for securing said structure member to a concrete form.

2. A concrete insert as defined in claim 1, wherein said anchoring means is separate and distinct from said channel member.

3. A concrete insert as defined in claim 1, wherein said staple comprises a U-shaped member having a pair of opposed leg portions and an interconnecting intermediate portion, said intermediate portion being disposed on one side of said web portion, and said leg portions of said staple projecting through its corresponding slot to extend to the other side of said web portion.

4. A concrete insert as defined in claim 1, wherein said side portions of said channel member have their respective free ends reversely turned.

5. A concrete insert as defined in claim 1, wherein the respective ends of said side portions are inwardly and reversely turned.

6. A concrete insert as defined in claim 1, wherein said leg portions of said staple have a free end that is reversely turned.

7. A concrete insert as defined in claim 1, wherein said leg portions have their respective ends outwardly and reversely bent.

8. A concrete insert as defined in claim 1, wherein said securing means comprises aligned openings disposed in said web portion and intermediate portion of said staple, and a fastener extended through said aligned openings.

9. A concrete insert as defined in claim 8, wherein said fastener has an enlarged head end portion, said enlarged head end portion having a diameter greater than one of said aligned openings.

10. A concrete insert comprising an elongated structural member having a pair of opposed side portions and a connected web portion, said web portion having a plurality of spaced apart slots formed therein, said slots extending transversely of said web portion, the distance between each slot in said pair of slots being greater than the transverse width of said web portion, at least one aperture formed in said web between adjacent pairs of slots, said opposed side portions having end portions that are inwardly and reversely bent, anchoring means spaced along said web portion, said anchoring means including a U-shaped staple having opposed leg portions and a connected intermediate portion, said leg portion being frictionally inserted through adjacent pair of slots so that said intermediate portion of said staple is disposed to one side of said web portion, and said leg portion projection through its respective slot to extend to the other side of said web portion, and said intermediate portion of said staple having an opening formed therein disposed in alignment with said aperture, a fastener extending through said aligned aperture and opening for securing said structural member to a concrete form; and said leg portion having free ends that are reversely bent.

* * * * *